US012090381B2

(12) United States Patent
Martin

(10) Patent No.: US 12,090,381 B2
(45) Date of Patent: Sep. 17, 2024

(54) HEAD TARGET FOR MARTIAL ARTS PRACTICE

(71) Applicant: Sean E. Martin, Pittsburg, PA (US)

(72) Inventor: Sean E. Martin, Pittsburg, PA (US)

( * ) Notice: Subject to any disclaimer, the term of this patent is extended or adjusted under 35 U.S.C. 154(b) by 0 days.

(21) Appl. No.: 17/464,667

(22) Filed: Sep. 1, 2021

(65) Prior Publication Data

US 2023/0061759 A1 Mar. 2, 2023

(51) Int. Cl.
*A63B 69/34* (2006.01)
*A63B 71/06* (2006.01)

(52) U.S. Cl.
CPC ..... *A63B 69/34* (2013.01); *A63B 71/0622* (2013.01); *A63B 2071/0625* (2013.01); *A63B 2244/10* (2013.01)

(58) Field of Classification Search
None
See application file for complete search history.

(56) References Cited

U.S. PATENT DOCUMENTS 3,610,486 A * 10/1971 Kunzmann ..... A45D 44/14 223/66
4,691,556 A * 9/1987 Mellander ..... G01M 17/0078 73/1.15
4,991,231 A * 2/1991 Swift ..... A63B 69/215 482/88
5,897,446 A * 4/1999 Wiseman ..... A43B 5/02 36/114
7,204,165 B1 * 4/2007 Plaga ..... G01N 3/30 73/12.01
9,378,656 B2 * 6/2016 Cooper ..... G09B 19/0015
9,428,003 B2 * 8/2016 Gill, Jr. ..... B44C 5/02
10,188,893 B2 * 1/2019 Johnson ..... A63B 21/072
D846,677 S * 4/2019 Chen ..... D21/798
10,400,950 B1 * 9/2019 Hauser ..... F16M 13/02
11,173,354 B2 * 11/2021 Jordan ..... A63B 21/028
11,538,363 B2 * 12/2022 Kraus ..... A63B 69/34
11,554,307 B1 * 1/2023 Talv ..... A63B 69/26
11,654,342 B2 * 5/2023 Wilson ..... A63B 69/224 482/87
2005/0244795 A1 * 11/2005 Long ..... A63B 69/215 434/23
2009/0082179 A1 * 3/2009 Le ..... A63B 69/26 482/88
2011/0118092 A1 * 5/2011 Keary, III ..... A63B 69/224 482/87
2013/0296141 A1 * 11/2013 Partlo ..... A63B 69/32 482/84

(Continued)

FOREIGN PATENT DOCUMENTS

GB 951042 A * 3/1964
GB 2550133 A * 11/2017 ..... A63B 69/26
WO WO-2016080929 A1 * 5/2016 ..... A63B 69/004

*Primary Examiner* — Shila Jalalzadeh Abyaneh
(74) *Attorney, Agent, or Firm* — Dobbin IP Law, P.C.; Geoffrey E. Dobbin

(57) ABSTRACT

A head target with may feature realistic eye targets and a rearward handle for use in martial arts practices. The handle may be constructed in a manner to also allow the use of a wall mount with a plurality of support spurs to support the head target in a realistic posture in a manner to withstand multiple blows from the training individual. A mounting plate, upon which the wall mount is positioned, aids in a secure mounting to a wall.

10 Claims, 6 Drawing Sheets

(56) References Cited

U.S. PATENT DOCUMENTS

| | | | | |
|---|---|---|---|---|
| 2014/0080681 | A1* | 3/2014 | Knight | A63B 69/215<br>482/83 |
| 2014/0148314 | A1* | 5/2014 | Schlicher | A63B 21/169<br>482/87 |
| 2016/0175678 | A1* | 6/2016 | Branch | A63B 69/32<br>482/84 |
| 2016/0220882 | A1* | 8/2016 | Milligan | A63B 71/0622 |
| 2017/0021255 | A1* | 1/2017 | Knight | A63B 69/20 |
| 2019/0009160 | A1* | 1/2019 | Penna | A63B 69/305 |

* cited by examiner

HEAD TARGET FOR MARTIAL ARTS PRACTICE

FIELD OF THE INVENTION

The present invention relates to the field of martial arts and more particularly relates to a head-shaped target for use in striking practices for said martial arts.

BACKGROUND OF THE INVENTION

"Martial arts" is a term used to describe a wide variety of hand-to-hand combat systems found across the globe and throughout history. Technically, any melee combat system and discipline may be termed a "martial art" so long as it has a codified system of combat. As such, the term martial arts can encompass either Western or Eastern styles, whether armed or unarmed. Often, martial arts will at some level focus on utilizing the parts of one's body, such as the hands, arms, feet, legs, and knees, as striking weapons in the event no force multiplier (i.e., a weapon) is present for use. As such, many martial arts have at least a set of maneuvers focusing on striking an opponent. To practice these and other maneuvers, most disciplines will utilize sparring, where participants practice on each other in a controlled setting, or practice dummies, where a participant can exert more force and intensity in practice and not hurt anybody else.

Practice dummies can be as simple as a punching bag or more complex like a mannequin, depending on the desired martial art and the desired maneuvers to be practiced. Practice dummies may also be a simple target held by another person for the purpose of imparting realism in the practice session. It should therefore be no surprise that there is a desire for a practice dummy to have a sense of realism about it. While many practice dummies do have more realism about them than others, they tend to lack certain elements of realism. A first element is an adaptive quality whereby a practice dummy could be utilized either with a partner (having the partner hold the dummy) or alone (having the dummy mounted upon a wall or other support) while still having realistic posture and attitude. Also, practice dummies are not as effective when practicing eye gouges or other hits to the eyes, moves taught in various forms of martial arts, because even the most realistic dummies have heads made of a unitary solid polymer or rubber block. As such, there lacks a sense of realism in that the eyes are a sensitive part of the human anatomy and too much force can cause more damage than what is desired to be inflicted, or too little not enough. Finally, most head targets do not have the ability to be adapted for various forms of head gear, including hats, helmets, glasses and goggles, and other protective clothing which will alter a practitioner's tactics during training exercises (e.g., helmets will protect various parts of the head, rendering strikes in those areas futile).

The present invention is a practice dummy resembling the human head which may be utilized in a solo or co-operative practice session while also presenting realistic eye structures, as well as ear, nose, throat/trachea, and temple structures, for practicing shots to striking points on or about the head and neck. As a head target, the present invention is more portable and lighter than a full practice dummy, and still allows for a more realistic training session. The present invention also represents a departure from the prior art in that the practice dummy of the present invention allows for either mounting on a support or being held by a partner as may be available to the participant.

SUMMARY OF THE INVENTION

In view of the foregoing disadvantages inherent in the known types of practice dummy, an improved head-target practice dummy may provide a practice dummy that meets the following objectives: it may be utilized in either singular practice or with a partner, that it may easily be converted from one mode of practice to the other, that it present more realistic eye targets, that it be simple to manufacture, and that it be economically produced for an expanded market. As such, a new and improved practice dummy may comprise a head portion, with specialized squeaking eye targets, and a wall mount structure that will interface with the head portion and maintain the head in a natural position to accomplish these objectives.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

To describe the way the above-recited and other advantages and features of the invention can be obtained, a more particular description of the invention briefly described above will be rendered by reference to specific example embodiments thereof which are illustrated in the appended drawings. Understanding that these drawings depict only typical embodiments of the invention and are therefore not to be considered as limiting of its scope, the invention will be described and explained with additional specificity and detail using the accompanying drawings.

LISTING OF REFERENCE NUMERALS

20—Wall
27—Mounting bolts
50—Human Arm/Hand
60—Glasses
70—Helmet
100—Head Target
110—Squeaking Eye Target
120—Upper Recess
130—Middle Recess
140—Lower Recess
150—Handle
160—Eyewear Grooves
200—Target Mount
220—Upper Spur
230—Middle Spur
240—Lower Spur
250—Handle Recess
260—Mounting Plate
270—Mounting Springs.

DETAILED DESCRIPTION OF THE PREFERRED EMBODIMENT

With reference now to the drawings, a preferred embodiment of the head target for martial arts practice is herein described. It should be noted that the articles "a", "an", and "the", as used in this specification, include plural referents unless the content clearly dictates otherwise.

Figure 1:
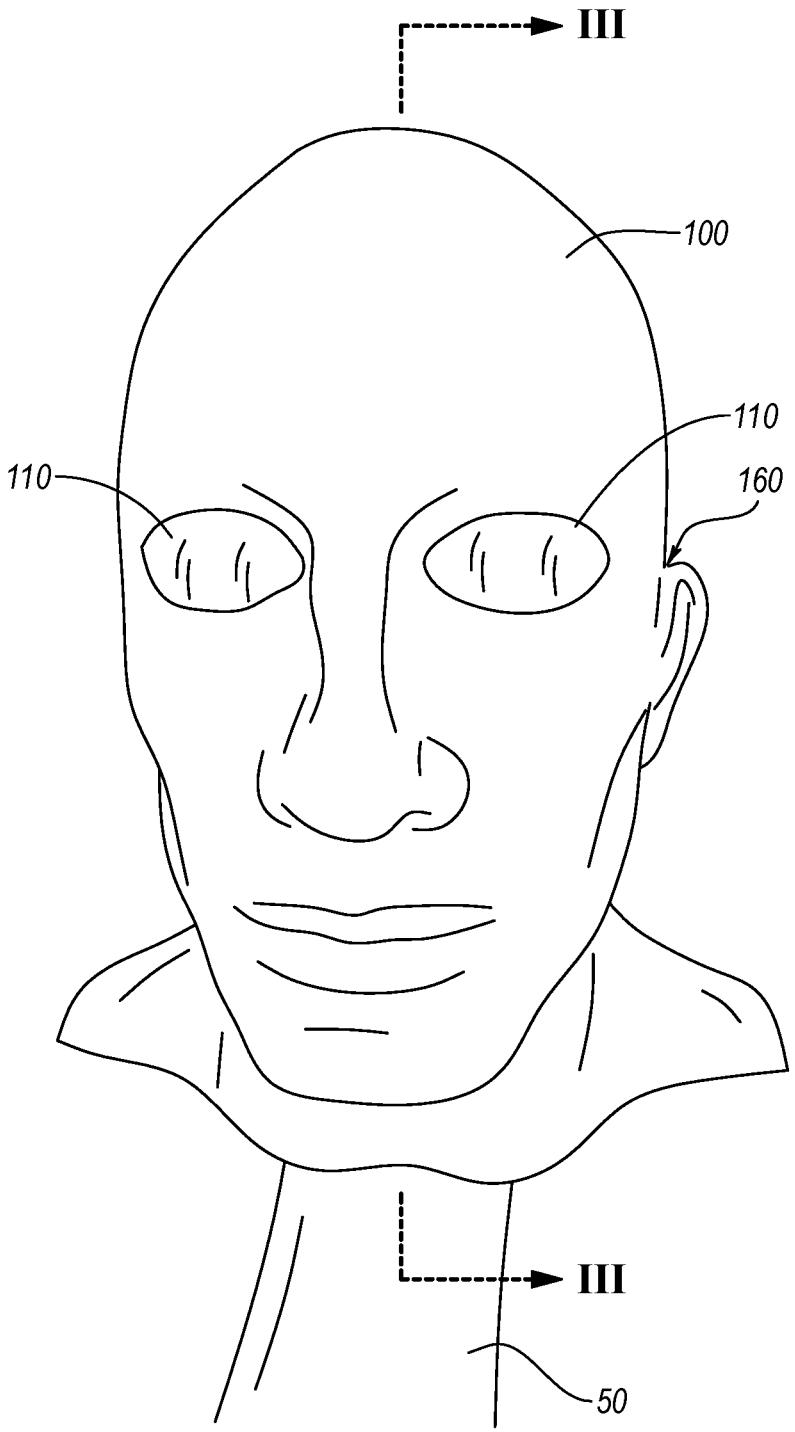
FIG. 1 is a front elevation of an exemplary embodiment of the head target for martial arts practice, in use by an individual.
Figure 2:
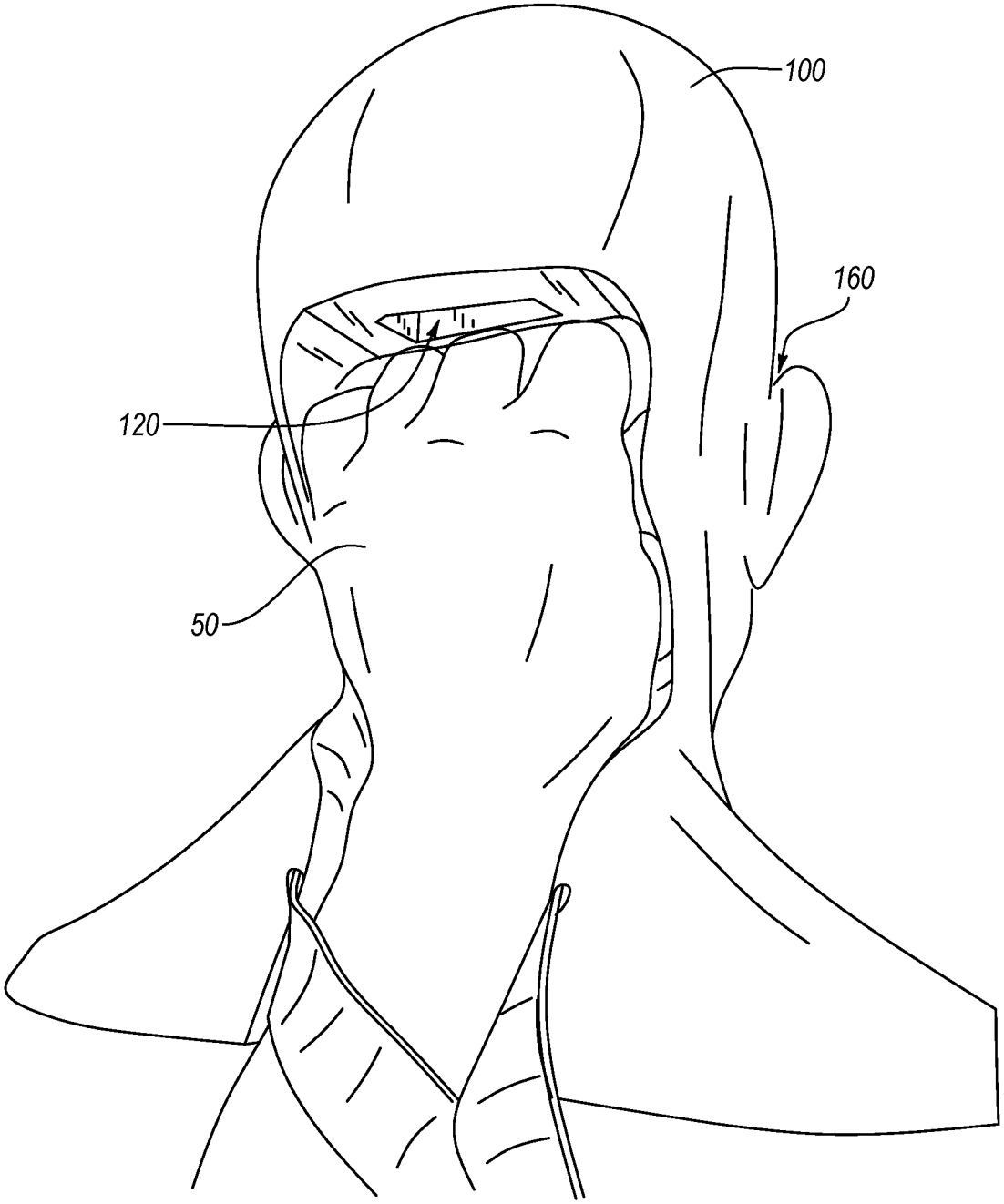
FIG. 2 is a rear perspective view of the head target of FIG. 1.
Figure 3:
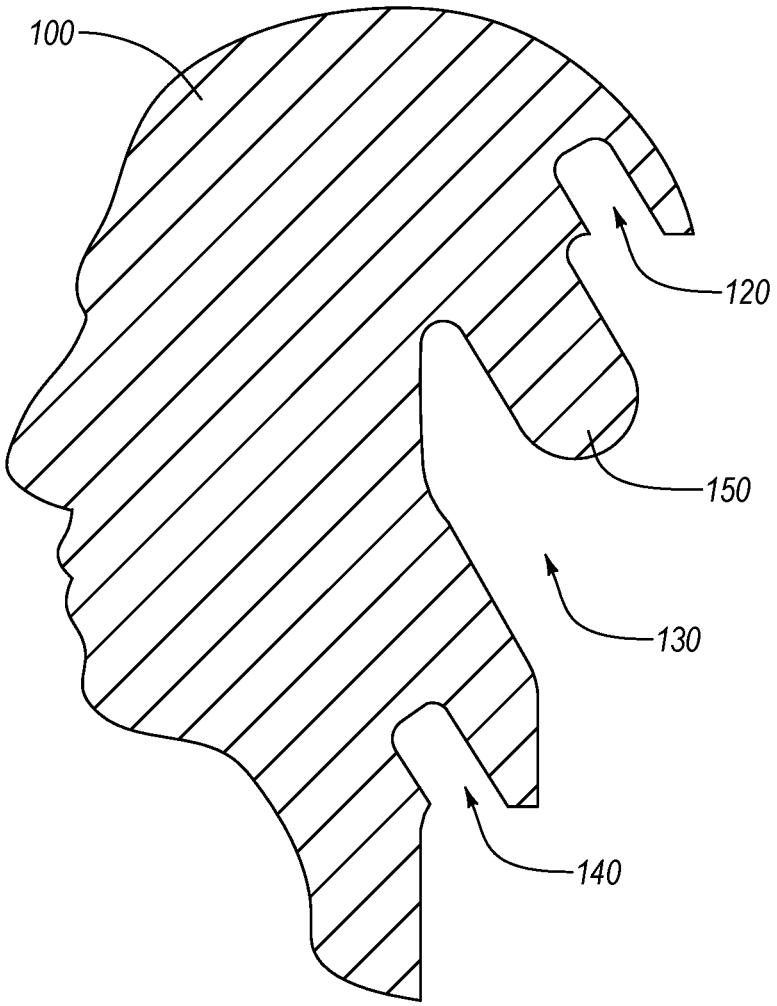
FIG. 3 is a sectional view of the head target of FIG. 1, taken along line III-III, without the individual's hand and arm.

With reference to FIGS. 1-3, a head target 100 shaped in general conformance with a human head may be held by a partner 50 in a practice session. The head target 100 provides analogues to the common striking points utilized in many martial arts: eyes, ears, nose, throat/trachea, and temples. The head target 100 also features a handle 150 with appropriate recesses 120, 130 to accommodate a human hand 50 and provide a strong support for gripping the target 100. A third recess 140 may be provided for added stability when interfacing with the mount 200. In use, the partner will hold and move the head target 100 to provide a more realistic target for the practitioner to strike. The handle 150 provides a sturdy grip surface, allowing the partner to better hold the head target 100 during repeated strikes.

One of the more realistic features of the head target 100 is the use of specifically implanted eye targets 110. The eye targets 110 are air squeakers and therefore will yield to pressure while emitting a squeak to indicate a proper hit. Too much pressure from a hit may dislodge the eye targets 110, which could indicate too much force in less dire situations. The fact the targets will yield to pressure is a more realistic simulation of the human eye and will provide more realistic interaction for the practitioner. The eye targets 110 may also be made to be replaceable as they may be more prone to damage than the remainder of the head target 100.

Figure 4:
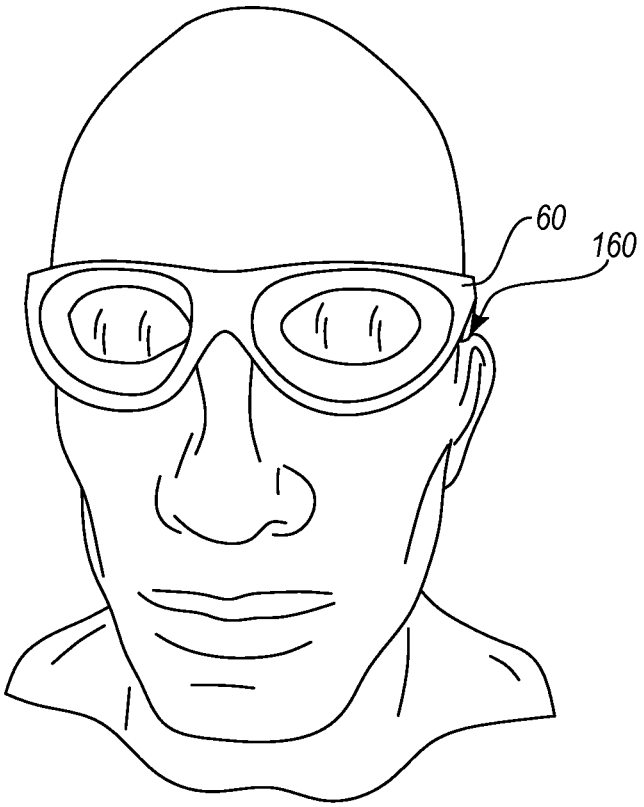
FIG. 4 is a front elevation of the head target of FIG. 1, with simulated glasses installed.
Figure 5:
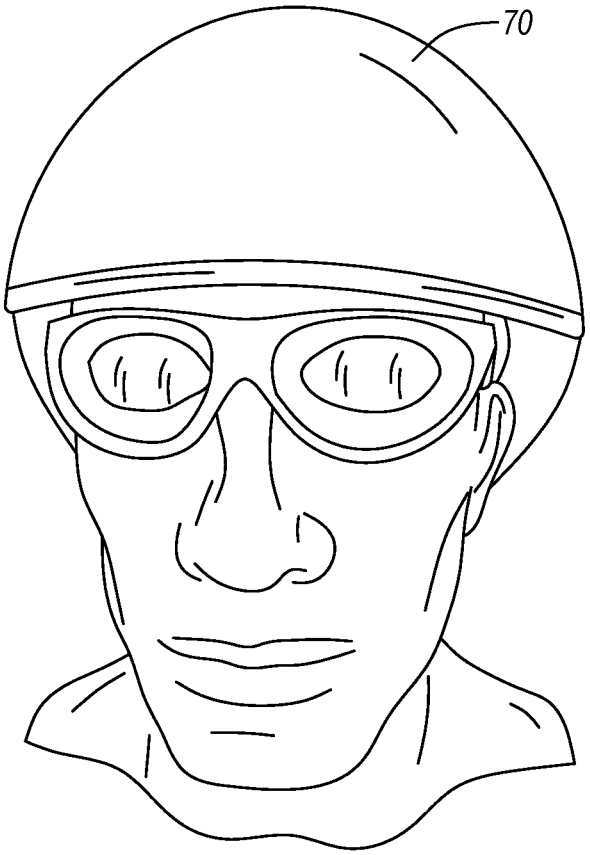
FIG. 5 is a front elevation of the head target of FIG. 4, with a helmet installed.

Another realistic feature is the addition of eyewear groves 160 over the ears of the head target 100 (FIG. 4) and the general rounded shape of the head. These grooves allow the incorporation of eyewear over the face of the target 100. Various forms of glasses 60 or goggles will influence the type of eye or nose strikes a practitioner will use. Likewise, other head and neck gear may be incorporated on the head target 100. Neck protection will limit trachea strikes. Helmets will frequently limit temple and ear strikes. In fact, striking such protected areas will not only have no effect on the intended target, but also could even injure the practitioner. Therefore, when training, the practitioner will endeavor to avoid those protected areas and maximize effectiveness in other areas of the head target 100. The rounded shape of the head target 100 allows for a helmet 70 or other head or neck gear to be more realistically positioned thereupon for this type of training simulation (FIG. 5).

Figure 6:
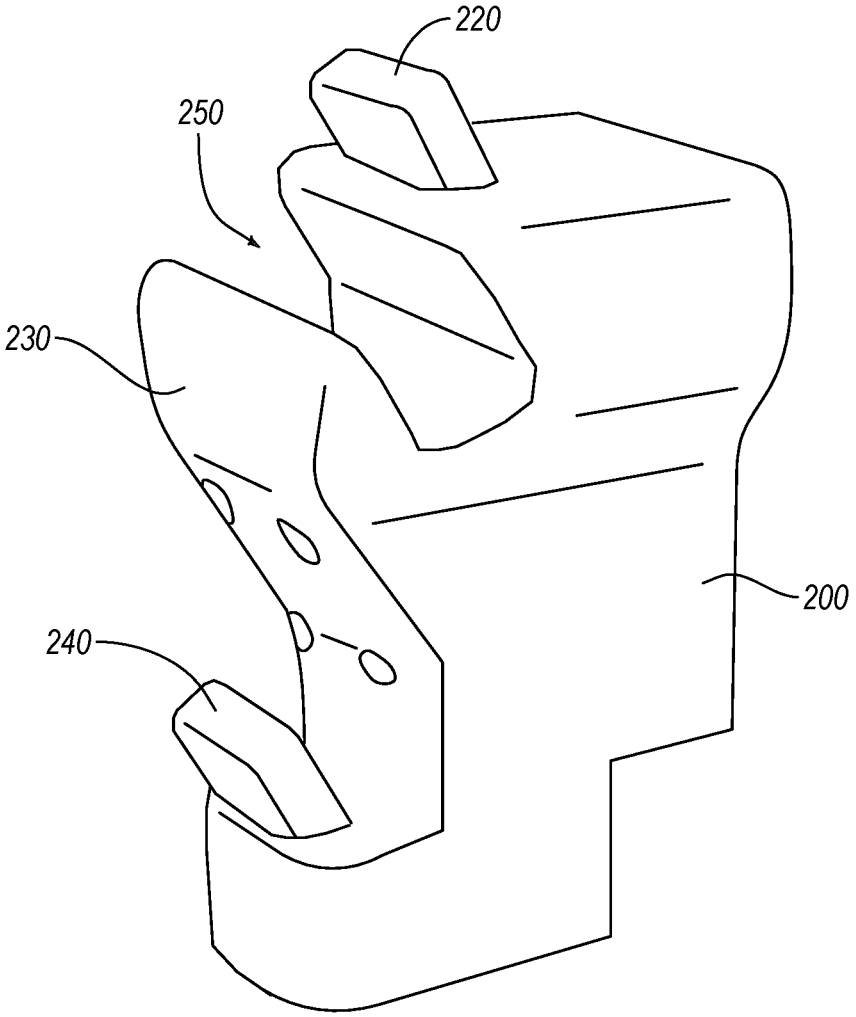
FIG. 6 is a perspective view of a target mount for use with the head target of FIG. 1.
Figure 7:
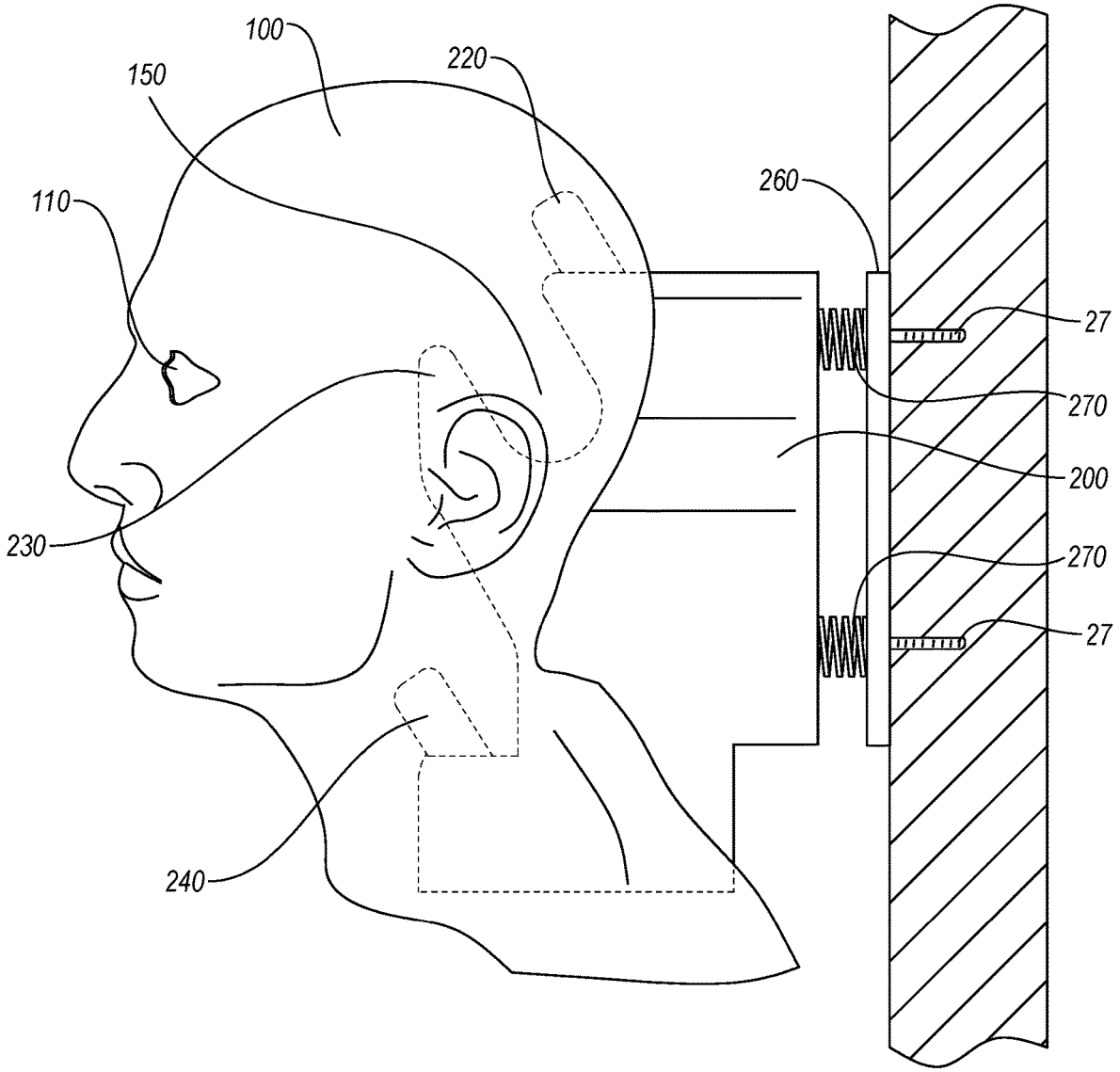
FIG. 7 is a side elevation, in partial transparency, of the head target of FIG. 1 mounted upon the target mount of FIG. 6.

The use of a wall mount 200 (FIGS. 6 and 7) allows for the use of the head target 100 in a solo setting. The ideal wall mount 200 presents three spurs 220, 230, 240 which will mate with the recesses 120, 130, 140 in the head target and define a recess 250 for accommodating the handle 150. The wall mount 200 may be angled and mounted in a manner to simulate a person's carriage by both its inherent shape and where it is mounted. Ideally, the wall mount 200 will be mounted upon a wall 20 using a plurality of mounting bolts 22. The number of spurs and recesses is variable across different embodiments. The use of three, two recesses 120, 130 about the handle 150 and a third 140 beneath the handle structure, along with the associated spurs 220, 230, 240 and the interfacing of the handle 150 with its associated recess 250 provides an adequate anchoring of the head target 100 to the wall 20 as the three points of contact are evenly distributed along the height of the head target 100. The disclosed embodiment also minimizes the number of recesses in the head target 100 while providing the handle 150 as added support to the mounting interface. However, the use of three is only exemplary and preferred. Additional or fewer such structures may be utilized and come within the purview of the invention.

Realism is enhanced by utilizing a mounting plate 260 connected to the rear of the wall mount 200 by springs 270. The mounting plate 260 is then secured to the wall 20 or other support by mounting bolts 27. The use of the springs 270 allows some resistive motion of the head target 100 when struck. Positioning of the head target 100 on the wall 20 or other support will then provide an appropriate attitude for the target, both in posture and height. The mounting plate 260 also acts as an intermediary support to help keep the bolts 27 secure despite repeated impacts.

Ideally the head target 100 should be made of materials common to other training dummies. These materials may include silicone, latex, rubber, and any structures for internal support. The wall mount may be made of any suitable, sturdy material which could include wood, metal, polymer, fiberglass, or composites. The eye targets may be made of a compressible polymer with a contained squeaking valve, such is common with children's and pets' toys.

Although the present invention has been described with reference to preferred embodiments, numerous modifications and variations can be made and still the result will come within the scope of the invention. The described embodiments are to be considered in all respects only as illustrative and not restrictive. No limitation with respect to the specific embodiments disclosed herein is intended or should be inferred. Therefore, the scope of the invention is indicated by the appended claims rather than by the foregoing description. All changes which come within the meaning and range of equivalency of the claims are to be embraced within their scope.

What is claimed is:

1. A practice head target for striking practice comprising:
a target body shaped in general conformance with a human head, the target body comprising:
a plurality of internal squeaking targets contained within the target body and positioned proximate eyes of the target body;
a handle opposite the plurality of squeaking targets for manual manipulation of the target body during practice sessions; and
two recesses proximate the handle; and
a wall mount structure comprising:
two spurs configured to interface with the two recesses of the target body; and
a recess, defined by the two spurs, configured to interface with the handle of the target body and support the same.

2. The practice head target of claim 1, wherein the wall mount structure further comprises:
a wall mount body having the two spurs;
a wall mount plate located on a side of the wall mount body opposite the two spurs; and
at least one spring positioned between the wall mount body and the wall mount plate.

3. The practice head target of claim 2, wherein the target body further comprises a third recess beneath the handle, and the wall mount body further comprises a third spur configured to interface with the third recess.

4. The practice head target of claim 1, further comprising eyewear grooves located proximate ears of the target body which.

5. The practice head target of claim 4, wherein the wall mount structure further comprises:
a wall mount body having the two spurs;
a wall mount plate located on a side of the wall mount body opposite the two spurs; and
at least one spring positioned between the wall mount body and the wall mount plate.

6. A practice head target for striking practice comprising:
a target body shaped in general conformance with a human head, the target body comprising:
a handle for manual manipulation of the target body during practice sessions; and
two recesses proximate the handle; and
a wall mount structure comprising:
two spurs configured to interface with the two recesses of the target body; and
a recess, defined by the two spurs, configured to interface with the handle of the target body and support the same.

7. The practice head target of claim 6, the wall mount structure further comprising:
a wall mount body having the two spurs;
a wall mount plate located on a side of the wall mount body opposite the two spurs; and
at least one spring positioned between the wall mount body and the wall mount plate.

8. The practice head target of claim 7, wherein the target body further comprises a third recess beneath the handle, and the wall mount body further comprises a third spur configured to interface with the third recess.

9. The practice head target of claim 6, further comprising eyewear grooves located proximate ears of the target body.

10. The practice head target of claim 9, the wall mount structure further comprising:
a wall mount body having the two spurs;
a wall mount plate located on a side of the wall mount body opposite the two spurs; and
at least one spring positioned between the wall mount body and the wall mount plate.

* * * * *